United States Patent [19]

Kiefer et al.

[11] Patent Number: 4,938,888

[45] Date of Patent: Jul. 3, 1990

[54] DETERGENT SHEET WITH ALKYL POLYGLYCOSIDE COMPOSITION

[75] Inventors: Jesse J. Kiefer, Valley Cottage; Michael P. Aronson, West Nyack; William M. Karpusiewicz, Floral Park; Karl F. Moschner, Troy, all of N.Y.

[73] Assignee: Lever Brothers Company, New York, N.Y.

[21] Appl. No.: 293,725

[22] Filed: Jan. 5, 1989

[51] Int. Cl.[5] ..... C11D 17/06

[52] U.S. Cl. ..... 252/91; 252/8.75; 252/90; 252/174; 252/174.17; 252/174.24

[58] Field of Search ..... 252/174.17, 174, 90, 252/91, 92, 93, 8.6; 427/242

[56] References Cited

U.S. PATENT DOCUMENTS

| | | | |
|---|---|---|---|
| 2,112,963 | 4/1938 | Jones | 15/208 |
| 2,665,528 | 1/1954 | Sternfield et al. | 51/185 |
| 3,308,067 | 3/1967 | Diehl | 252/550 |
| 3,694,364 | 9/1972 | Edwards | 252/90 |
| 4,095,946 | 6/1978 | Jones et al. | 8/137 |
| 4,170,565 | 10/1979 | Flesher et al. | 252/93 |
| 4,220,562 | 10/1980 | Spadini et al. | 252/542 |
| 4,483,780 | 11/1984 | Llenado | 252/135 |
| 4,493,773 | 1/1985 | Cook et al. | 252/8.8 |

*Primary Examiner*—Prince E. Willis
*Assistant Examiner*—A. Beadles-Hay
*Attorney, Agent, or Firm*—Milton L. Honig

[57] ABSTRACT

A cleaning article is formed from a detergent composition impregnated into a flexible substrate. The detergent composition includes an alkyl polyglycoside and a detergency builder, the weight ratio of the total amount of surfactant to total amount of builder is at least 1:1. Especially useful are the polycarboxylate polymeric builders. Polyoxyethylene/polyoxypropylene copolymer may be used as a surfactant in conjunction with the alkyl polyglycoside.

14 Claims, No Drawings

DETERGENT SHEET WITH ALKYL POLYGLYCOSIDE COMPOSITION

BACKGROUND OF THE INVENTION 1. Field of the Invention

The invention relates to an article for cleaning fabrics in the form of a detergent impregnated flexible substrate. 2. The Prior Art Heavy duty detergent products for laundering of fabrics conventionally have been sold in the form of powders and liquids. Consumers have been required to measure appropriate dosages from containers holding these products. This measuring process sometimes leads to accidental spillage, often is inaccurate, and can generally be described as messy or inconvenient.

Therefore, the industry has sought to overcome these problems by use of a single article containing premeasured amounts of detergent plus other functional cleaning aids within a single package. Two approaches have been taken to providing a single dosage article, namely pouches and impregnated sheets.

Pouches filled with powdered detergents are now presently on the market. These products have some inherent delivery problems. Transfer of the powder actives through the pouch walls is not always sufficiently fast. There are also limits to the amount of product that can be dosed per pouch. By virtue of its construction, the pouch is also bulky and rather large.

Impregnated detergent sheets have for some time now been known in the art. U.S. Pat. No. 2,112,963 (Jones) reports paper substrates with a plurality of uniformly distributed perforations. Within the substrate there may be a detergent active composition. Passage of water through the perforations then aids in the release of detergent active to the substrate surface. U.S. Pat. No. 2,665,528 (Sternfeld et al.) reports a fibrous nonwoven fabric or high wet strength paper which may either be impregnated or laminated with a detergent abrasive cleanser composition. U.S. Pat. No. 3,694,364 (Edwards) discloses a laundering aid in the form of an amine-coated modified cellulosic substrate in combination with a detergent. A wide variety of detergents are encompassed within that disclosed invention including ethylene oxide/propylene oxide type nonionic surfactants. U.S. Patent 4,095,946 (Jones et al.) is concerned with a laundry article in substrate form impregnated with both a surfactant and a fabric softening agent.

Certain disadvantages have been noted with single sheet type cleaning articles. The range of formulation possibilities is constricted by aesthetic requirements. There must be a reasonable feel and hand to the impregnated substrate. Thus, very tacky or wet detergent compositions must be avoided. Likewise, the impregnated sheet must have a certain degree of flexibility for ease of use and consumer appeal. A highly solid or brittle detergent composition cannot be employed. If the composition is too soft, however, there will be an unappealing greasiness or wetness in handling the sheet.

Accordingly, it is an object of the present invention to provide a cleaning article in the form of a detergent impregnated substrate having flexibility and when handled avoids a wet, greasy or tacky feel.

A further object of the present invention is to provide an effective cleaning article for use in an automatic washing machine for laundering fabrics. A still further object of the present invention is to provide a cleaning article which is simple in its manufacture and convenient to store.

SUMMARY OF THE INVENTION

A cleaning article is provided comprising:

(i) a flexible substrate; and (ii) a detergent composition impregnated into said substrate, said composition comprising:

(a) one or more surfactants which include an alkyl polyglycoside of the formula:

$$RO(R'O)_y(Z)_x$$

wherein R is a monovalent organic radical containing from about 6 to about 30 carbon atoms; R' is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 10;

(b) a detergency builder, and wherein the weight ratio of the total amount of surfactant to that of total amount of builder is at least 1:1.

A particularly useful type of builder within the present invention is that of the polycarboxylate polymers, especially those exemplified by polyacrylic acid salts and copolymers of polyacrylic acid with maleic acid. Advantageously, there may also be present alongside the alkyl polyglycoside a further surfactant which is a polyoxyethylene/polyoxypropylene copolymer.

DETAILED DESCRIPTION OF THE INVENTION

According to the present invention, it has been discovered that non-tacky yet non-brittle detergent compositions can be prepared wherein the major surfactant is an alkyl polyglycoside. This surfactant corresponds to the formula:

$$RO(R'O)_y(Z)_x$$

wherein R is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; R' is a divalent hydrocarbon radical containing from 2 to about 4 carbon atoms such as ethylene, propylene or butylene (most preferably the unit $(R'O)_y$ represents repeating units of ethylene oxide, propylene oxide and/or random or block combinations thereof); y is a number having an average value of from 0 to about 12; Z represents a moiety derived from a reducing saccharide containing 5 or 6 carbon atoms (most preferably a glucose unit); and x is a number having an average value of from 1 to about 10 (preferably from 1.0 to about 5 and more preferably from about 1.2 to about 2).

Glycoside surfactants suitable for use herein also include those of the formula above in which one or more of the normally free (i.e., unreacted hydroxyl groups of the saccharide moiety, Z, have been alkoxylated; preferably, ethoxylated or propoxylated) so as to attach one or more pendant alkoxy or poly (alkoxy) groups in place thereof. In such event, the amount of alkylene oxide (e.g., ethylene oxide, propylene oxide, etc.) employed will typically range from about 1 to about 20 (preferably from about 3 to about 10) moles thereof per mole of saccharide moiety within the formula glycoside material.

In glycosides of the formula above, the $RO(R'O)_y$ group is generally bonded or attached to the number 1 carbon atom of the saccharide moiety, Z. Accordingly, the free hydroxyls available for alkoxylation are typically those in the number 2, 3, 4 and 6 positions in 6–carbon atom saccharides and those in the number 2, 3, 4 positions in the 5–carbon atom saccharides species. Typically, the number 2 position hydroxyls in the 5-carbon saccharides, and the number 2 and 6 position hydroxyls in 6-carbon saccharides, are substantially more reactive or susceptible to alkoxylation than those ®in the number 3 and 4 positions. Accordingly, alkoxylation will usually occur in the former locations in preference to the latter.

Glycoside surfactants of particular interest for use in the practice of the present invention preferably have a hydrophilic-lipophilic balance (HLB) in the range of from about 10 to about 18 and most preferably in the range of from about 12 to about 14.

Within the compositions of the present invention, alkyl polyglycosides will be present in amounts ranging from about 5 to about 70% by weight, preferably from about 15 to about 35%, optimally between about 20 and 30%.

Commercially, alkyl polyglycosides are available from the Horizon Chemical Company. These materials are sold under the trademark APG. Particularly preferred is APG 500 which is a $C_{12}$–$C_{13}$ linear alcohol glycoside derivative having an average X (degree of glycoside polymerization) of 1.35.

In one embodiment of the invention, there is also present a co-surfactant active. Preferably, this co-surfactant is a condensation product of ethylene oxide with a hydrophobic base formed by the condensation of propylene oxide with propylene glycol. Advantageously, anywhere from 200 to 230 moles of ethylene oxide may be combined with from about 40 to 50 moles propylene oxide. A particularly preferred material in this category is Pluronic 25R8 ®which is commercially available from the BASF-Wyandotte Chemical Corporation.

When present, the amount of alkyl polyglycoside to ethylene oxide/propylene oxide copolymer will range in weight from about 6:1 to about 1:1, preferably from about 4:1 to about 2:1; optimally about 4:1.

Other secondary co-surfactants may optionally also be present. These may include other nonionic, anionic, cationic, zwitterionic surfactants and mixtures thereof. Within the nonionic group, it is sometimes desirable to include the condensation product of a $C_8$–$C_{22}$ alkyl aliphatic alcohol alkoxylated with from about 1 to about 25 moles ethylene oxide per alcohol unit. More specific examples include a $C_{14}$–$C_{15}$ alkyl aliphatic alcohol ethoxylated with from about 7 to about 13 moles ethylene oxide and a $C_{12}$–$C_{15}$ alkyl aliphatic alcohol alkoxylated with about 9 moles ethylene oxide. These are sold commercially as Neodol 45–LST ®and Neodol 25–9 ®, respectively, available from the Shell Chemical Company.

Many other co-surfactants can be utilized. These will be apparent to the art as described at length in "Surface Active Agents and Detergents", by Schwartz, Perry & Berch, Interscience Publishers, Inc., herein incorporated by reference.

Another important component of the cleaning article is that of a detergency builder. It is important that the total weight of builder be no greater than the total weight of surfactant. Where builder is in excess of total surfactant there will result a problem with obtaining sufficient flow of the detergent composition, poor impregnation of the substrate, and result in brittle articles. Thus, the weight ratio of total surfactant to total builder will be at least 1:1, preferably from about 20:1 to 1:1, more preferably from about 5:1 to 2:1, optimally about 4:1.

An especially desirable type of builder within the context of the present invention is that of a polymeric polycarboxylate. Within this category there has been found suitable the sodium polyacrylate series sold as Acrysol ®by the Rohm & Haas Company. Molecular weights ranging from 1,000 to 60,000, most preferably between 4,500 and 10,000 have been found to be most useful. Likewise, it is also effective to employ a copolymer of polyacrylic acid and maleic acid. Here a specially useful copolymer is that having an average molecular weight of 50,000 with a molar ratio of acrylic to maleic acid of about 2:1. The material is sold under the trademark of Sokalan CP–7 ®, a product of the BASF Corporation.

There might also be employed other conventional inorganic or organic builder salts. Typical of the well known inorganic builders are the sodium and potassium salts of pyrophosphate, orthophosphate, tripolyphosphate, carbonate, bicarbonate, silicate, sesquicarbonate, borate and aluminosilicate. Among the organic detergent builders that can be used are the sodium and potassium salts of citric acid, nitrilotriacetic acid, tartrates, oxidisuccinates, carboxymethyloxysuccinates and mixtures of these materials.

The Substrate

Substrates employed herein are water-insoluble and are solid or substantially solid materials. They can be dense or open in structure, preferably the latter. Examples of suitable materials which can be used as a substrate include foam, foil, sponge, paper, woven or non-woven cloth. Absorbent capacity, thickness or fiber density are not limitations on the substrates which can be used herein, so long as the substrates exhibit sufficient wet-strength to maintain structural integrity through the complete washing cycles in which they are used.

Paper substrates which can be employed herein encompass the broad spectrum of known paper structures and are not limited to any specific papermaking fiber or wood pulp. Thus, the fibers derived from soft woods, hard woods, or annual plants (e.g., bagasse, cereal straw, and the like), and wood pulps, such as bleached or unbleached kraft, sulfite, soda ground wood, or mixtures thereof, can be used. Moreover, the paper substrates which can be employed herein are not limited to specific types of paper, as long as the paper exhibits the necessary wet-strength and thermal stability.

The substrate may be formed of a number of plies. For instance, a paper substrate may be constructed of a 2 or more ply paper.

Preferred non-woven cloth substrates used in the invention herein can generally be defined as adhesively bonded fiberous products, having a web or corded fiber structure or comprising fiberous mats, in which the fibers are distributed haphazardly or in a random array or substantially aligned. Natural fibers may be utilized including wool, silk, jute, hemp, cotton, linen, sisal or ramie. Synthetic fibers are also suitable and may include rayon, cellulose ester, polyvinyl derivatives polyolefins polyamides or polyesters. Any diameter or denier of the fiber, generally up to about 10 denier, can be used in the present invention.

Substrates usable herein can be "dense", or they can be open and have a high amount of 37 free space". Free space, also called "void volume", is that space within a substrate structure which is unoccupied. For example, certain absorbent, multi-ply paper structures comprise plies embossed with protuberances, the ends of which are mated and joined. This paper structure has free space between the unembossed portions of the plies, as well as between the fibers of the paper plies themselves. A non-woven cloth also has such space among its fibers. The free space of the substrate can be varied by modifying the density of the fibers of the substrate. Substrates with a high amount of free space generally have low fiber density, and substrates having high fiber density generally have a low amount of free space.

The substrate is preferably one having sufficient loft so that a proper loading of detergent composition can be achieved. Proper loft may be determined by the size of the final sheet and the desired delivery of detergent composition. There are no limitations on size. As size increases for a constant detergent delivery, the required loft will decrease. However, non-wovens with higher loft requirements are generally more costly.

Manufacture

The application of the detergent composition can be done in any of a number of methods. Typically, impregnation coatings can be applied via slot die extrusion, reverse role coating, dip and squeeze techniques or any method wherein substrate is allowed sufficient residence time to be completely saturated by the coating solution. Moisture removal, where required, can be done by any of a number of known drying procedures. Typically, drying processes useful herein are air floatation, conventional convection drying, infrared drying, and microwave drying. These processes all fall within the known manufacturing concept of converting.

The following examples will more fully illustrate the embodiments of this invention. All parts, percentages and proportions referred to herein and in the appended claims are by weight unless otherwise stated.

EXAMPLE 1

Illustrated hereinbelow is a detergent sheet article constructed of a rayon/polyester substrate whose fibrous structure is impregnated with an aqueous detergent formulation starting at the surface of one side of the substrate and extending through to an opposite surface. Residual moisture in the applied slurry is removed by evaporation leaving an essentially anhydrous mixture of detergent actives effectively trapped within the substrate as described above.

In addition to the detergent, a fabric softener (quaternary ammonium salt) composition has also been incorporated into the substrate in the form of a stripe. Thus, there is a portion of the article with an area 1.75 inches by 10.5 inches continuing through the thickness of the substrate that contains the fabric softening composition. Subsequently, this area becomes overcoated with the detergent composition during the manufacturing process. The softening composition is formulated such that it is released near the end of the wash cycle and possibly in the beginning of the rinse. A detailed description of the aqueous detergent slurry composition is given in Table I.

TABLE I

| Detergent Slurry | |
|---|---|
| Component | Weight % |
| Alkyl Polyglycoside (APG 500 CS) | 29.99 |
| Pluronic 25R8 ® | 7.50 |
| Sokalan CP-7 ® | 7.50 |
| Sodium Carbonate | 4.50 |
| Fluorescer | 0.54 |
| Perfume | 0.16 |
| Colorant | 0.02 |
| Water | 49.79 |
| Total | 100.00 |

The liquid detergent composition was made by allowing the Pluronic 25R8 ®to melt in a heated pot. After all of the Pluronic was melted, APG-500 CS was added to the Pluronic with minimum agitation and allowed to mix until all of the lumps were dissolved. To this mixture a 40% aqueous Sokalan CP-7 ®solution was added and mixed for 20 minutes to give premix A. In a second mixing vessel a solution of water, soda ash and dye, premix B, was prepared and allowed to dissolve. Before mixing the two compositions together, the fluorescer was dispersed in premix A. After both mixes were combined, agitation continued for 10 minutes. Maximum batch temperature achieved was 140° F. After 10 minutes, cooling water was added to the water bath to reduce the batch temperature to 110° F. before adding the perfume. Thereafter, the mixture was agitated an additional 10 minutes to provide the completed slurry.

Coating of the substrate sheet was accomplished in two stages. First, a cationic fabric softener was impregnated onto a rayon/polyester non-woven web of Hovolin 7354®. Impregnation was performed by directly applying the fabric softener to the web by slot die extrusion. The metered die allowed a precise amount of cationic to be delivered to the web in the form of a dense stripe to minimize softener losses during the early part of the wash cycle. Three stripes were coated onto the web concurrently at a rate of 50 feet per minute with approximately 4 grams of coating per 10.5 inch of length.

After the cationic coating step was completed, the detergent composition was coated onto the non-woven substrate. A saturation technique was employed involving dipping the substrate into a pan of the detergent composition allowing an excess to be adsorbed by the web. Saturated substrate subsequently was passed through a nip present to a specified gap which squeezed the excess detergent from the substrate and returned same to the dip pan. The saturated web then passed through a three zone 30 foot flotation dryer set at 225° F. for zone 1 and 2 (the first 20 feet) and 260° F. for zone 3 (the last 10 feet). The dried sheets exiting the dryer were rewound onto a 30 inch long 3 inch ID core. Coating and drying was done at a speed of 2 feet per minute. Rewound cores were shrink wrapped to avoid excess moisture pickup.

Table II outlines the final dried composition of the coatings impregnated onto the substrate. Table III lists the properties of the Hovolin 7354 ®substrate.

TABLE II

| Dried Coating | |
|---|---|
| Component | Weight % |
| Alkyl Polyglycoside | 54.81 |
| Pluronic 25R8 ® | 13.70 |
| Sokalan CP-7 ® | 13.70 |
| Sodium Carbonate | 8.22 |
| Fluorescer | 0.99 |
| Colorant | 0.05 |
| Perfume | 0.30 |
| Ditallowdimethyl ammonium methyl sulfate | 5.80 |
| PEG 200 Monostearate | 2.50 |
| Total | 100.00 |

TABLE III

| Properties of Hovolin 7354 ® Substrate | |
|---|---|
| Weight (oz./yard) | 3.540 |
| Weight (g/sq. M) | 120.000 |
| Thickness (in.) | 0.076 |
| Porosity (CFM/ft$^2$) | 478.000 |

EXAMPLE 2

A cleaning article of the present invention was formed by impregnating the detergent slurry shown in Table IV onto a non-woven substrate 8×10½inches. The non-woven substrate was passed through a bath of the aqueous detergent slurry to allow saturation of substrate (99.5 g per linear foot) with the detergent composition. Excess slurry was removed by passing the saturated substrate through a knife-over-roll arrangement with a gap of 1.5 mm leaving 78.9 g per linear foot on the substrate. The resulting impregnated substrate was subjected to a temperature of 107° C. for 15 minutes to remove the excess moisture leaving 36.6 g per linear foot of dry coating on the substrate. The resultant articles were not tacky or greasy when the residual moisture was removed.

TABLE IV

| Detergent Slurry | |
|---|---|
| Component | Weight % |
| Alkyl Polyglycoside (APG 500 CS) | 35.61 |
| Pluronic 25R8 ® | 6.87 |
| Sodium Carbonate | 3.43 |
| Fluorescer | 0.34 |
| perfume | 0.07 |
| Colorant | 0.01 |
| Water | 53.67 |
| Total | 100.00 |

EXAMPLE 3

A cleaning article was prepared in the same manner as Example 1 except that the detergent slurry of Table V was utilized herein.

TABLE V

| Detergent Slurry | |
|---|---|
| Component | Weight % |
| Alkyl Polyglycoside (APG 500 CS) | 22.69 |
| Neodol 25-9 ® | 7.56 |
| Sokalan CP-7 ® | 7.56 |
| Sodium Carbonate | 12.10 |
| Perfume | 0.50 |
| Fluorescer | 0.50 |
| Colorant | 0.02 |
| Water | 49.07 |
| Total | 100.00 |

EXAMPLE 4

Experiments illustrated herein were directed at evaluating the tackiness imparted by various surfactants to the impregnated detergent sheet. A series of sheets with various surfactants was prepared according to the general procedure outlined in Example 1. Table VI reports the formulations which were used to impregnate the substrate material.

TABLE VI

| Detergent Formulations | | | | | |
|---|---|---|---|---|---|
| | Formulation No. | | | | |
| Component | A | B | C | D | E |
| APG 500 CS | 37.54 | 44.67 | — | 34.97 | — |
| Linear alkylbenzene sulfonate (LAS) | — | — | 30.13 | — | 33.40 |
| Pluronic 25R8 ® | — | — | — | 8.74 | — |
| PEG 3350 | — | — | 9.81 | — | — |
| Sodium Carbonate | 15.01 | 17.87 | 11.21 | 5.25 | 12.43 |
| Sodium Tripolyphosphate | — | — | — | 8.74 | — |
| Sokalan CP-7 ® | 9.39 | 11.17 | 7.00 | 8.74 | 7.77 |
| Fluorescent Whitener | 0.68 | 0.80 | .50 | 0.63 | 0.56 |
| Colorant | 0.03 | 0.03 | .02 | 0.03 | 0.03 |
| Neodol 25-9 ® | 9.39 | — | 9.81 | 12.24 | 10.87 |
| Water | 27.95 | 25.44 | 31.50 | 20.65 | 34.95 |

The detergent compositions outlined in Table VI were impregnated onto Hovolin 7354 ®substrate. For each formulation, two sheets were prepared differing only in formulation loading per unit area. These sheets were then cut into 5"×7"swatches and labeled with a blind code system. Panelists were then asked to subjectively rate each product for stickiness on a scale from 1 to 4. See Table VII.

TABLE VII

| Panel Test Results | | | |
|---|---|---|---|
| Formulation No. | Sheet Weight (g/84 in$^2$) | Tackiness Rating | Standard Pooled Variation ($\sigma^2$) |
| A | 24.36 | 2.4 | 0.5 |
| A | 37.87 | 1.8 | 0.28 |
| B | 18.15 | 1.4 | 0.59 |
| B | 37.21 | 1.0 | 0.0 |
| C | 32.67 | 2.4 | 0.50 |
| C | 41.58 | 2.6 | 0.59 |
| D | 24.84 | 3.3 | 1.96 |
| D | 42.30 | 3.3 | 0.26 |
| E | 42.20 | 2.6 | 0.85 |
| E | 26.50 | 2.3 | 0.85 |

| Rating Scale | |
|---|---|
| Value | Tackiness |
| 1 | solid, no tackiness |
| 2 | slightly tacky |
| 3 | tacky, sticky feeling |
| 4 | wet, greasy feeling |

All of the panelist evaluations were carried out at ambient conditions of 22–25° C. and relative humidity of about 60%.

The results of the panel demonstrate that different surfactant formulations provide different responses to tackiness and stickiness. Most preferred by the panelists were the sheets carrying formulation 2 which was an alkyl polyglycoside single surfactant composition. A statistical analysis determined that there was a statistically significant difference between a rating of 1 and that of 2 and 3. Thus, the APG system of formulation B was considered to be significantly less tacky than both the LAS/Neodol formulation C and the APG-/Neodol/Pluronic formulation D at the 95% confidence level. Panelists did not see any difference between APG/Neodol/Pluronic (D) from that of LAS/-Neodol (E) at the 95% confidence level. In some cases for a given surfactant formulation, the panelists were able to perceive differences in coating weight.

The foregoing description and Examples illustrate selected embodiments of the present invention. In light thereof, various modifications will be suggested to one skilled in the art, all of which are within the spirit and purview of the invention.

We claim:

1. A cleaning article comprising:

(i) A flexible substrate, said substrate being a single sheet and the only sheet of said cleaning article; and (ii) a detergent composition impregnated into said substrate, said composition comprising:

(a) one or more surfactants which include an alkyl polyglycoside of the formula:

$$RO\,(R'O)_y(Z)_x$$

wherein R is a monovalent organic radical containing from about 6 to about 30 carbon atoms; R' is a divalent hydrocarbon radical containing from 2 to about 4 carbon atoms; y is a number having an average value of from 0 to about 12: Z represents a moiety derived from a reducing saccharide containing 5 or 6 to about 10:

(b) a detergency builder, and wherein the weight ratio of the total amount of surfactant to that of total amount of builder is at least 1:1, said article having flexibility and when handled does not have a wet, greasy or tacky feel.

2. An article according to claim 1 wherein the builder is a polymeric polycarboxylate material.

3. An article according to claim 2 wherein said polycarboxylate is selected from the group consisting of the sodium salt of polyacrylic acid and acrylic/maleic coploymer.

4. An article according to claim 1 further comprising as a surfactant a polyoxyethylene/polyoxypropylene copolymer, the weight ratio of alkyl polyglycoside to said copolymer being from 6:1 to 1:1.

5. An article according to claim 4 wherein the weight ratio of alkyl polyglycoside to copolymer is from about 4:1 to about 2:1.

6. An article according to claim 1 wherein the weight ratio of total surfactant to total builder ranges from about 20:1 to 1:1.

7. An article according to claim 1 wherein the weight ratio of total surfactant to total builder ranges from about 5:1 to 2:1.

8. An article according to claim 1 wherein the alkyl polyglycoside is one where x has an average value from about 1.2 to about 2.

9. An article according to claim 1 wherein the flexible substrate is selected from the group consisting of foam, foil, sponge, paper, woven cloth and non-woven cloth.

10. An article according to claim 9 wherein the flexible substrate is a non-woven cloth of a material selected from the group consisting of rayon, polyester, polypropylene, polyethylene and mixtures thereof.

11. An article according to claim 1 further comprising a coating layer of fabric softening material directly on said flexible substrate, said fabric softening material coating being covered with a separate discrete coating layer of said detergent composition.

12. An article according to claim 11 wherein said fabric softening material comprises a quaternary ammonium salt.

13. An article according to claim 12 wherein said quaternary ammonium salt is a ditallow dimethyl ammonium salt.

14. An article according to claim 11 wherein the weight ratio of alkyl polyglycoside to fabric softening material ranges from 20:1 to 1:5.

* * * * *

UNITED STATES PATENT AND TRADEMARK OFFICE

CERTIFICATE OF CORRECTION

PATENT NO. : 4,938,888

DATED : July 3, 1990

INVENTOR(S) : Jesse J. Kiefer; Michael P. Aronson; William M. Karpusiewicz; Karl F. Moschner It is certified that error appears in the above—identified patent and that said Letters Patent is hereby corrected as shown below:

In claim 1, column 9, line 30, wherein "5 or 6 to about 10:" should read --5 or 6 carbon atoms; and x is a number having an average value of from 1 to about 10;--.

Signed and Sealed this

Fourth Day of August, 1992

*Attest:*

DOUGLAS B. COMER

*Attesting Officer*

*Acting Commissioner of Patents and Trademarks*